United States Patent [19]

Reichenecker

[11] Patent Number: 5,028,470

[45] Date of Patent: Jul. 2, 1991

[54] PACKAGING FILLERS

[75] Inventor: Hans Reichenecker, Metzingen, Fed. Rep. of Germany

[73] Assignee: Storopack Hans Reichenecker GmbH & Co., Metzingen, Fed. Rep. of Germany

[21] Appl. No.: 427,890

[22] Filed: Oct. 25, 1989

[30] Foreign Application Priority Data

Oct. 25, 1988 [EP] European Pat. Off. ..... PCT/EP88/00961

[51] Int. Cl.[5] ..... B32B 1/00; B65D 81/12

[52] U.S. Cl. ..... 428/81; 428/397; 206/584; 206/814

[58] Field of Search ..... 428/81, 402, 397; 206/523, 584, 814; 220/429

[56] References Cited

U.S. PATENT DOCUMENTS

| | | | |
|---|---|---|---|
| 3,188,264 | 6/1965 | Holden | 428/33 |
| 4,169,179 | 9/1979 | Bussey | 206/584 |
| 4,931,333 | 6/1990 | Henry | 206/584 |

*Primary Examiner*—Alexander S. Thomas
*Attorney, Agent, or Firm*—Jones, Tullar & Cooper

[57] ABSTRACT

A packaging filler formed by cutting off and expanding small pieces of continuously extruded plastic to have generally the shape of an H in plan view. The filler has a transverse part and a plurality of substantially elliptically shaped lateral parts extending from either end of the transverse part defining with the transverse part two spaced apart substantially rounded recesses. The length of the packaging filler is at least equal to the height of the lateral parts.

4 Claims, 1 Drawing Sheet

FIG.1
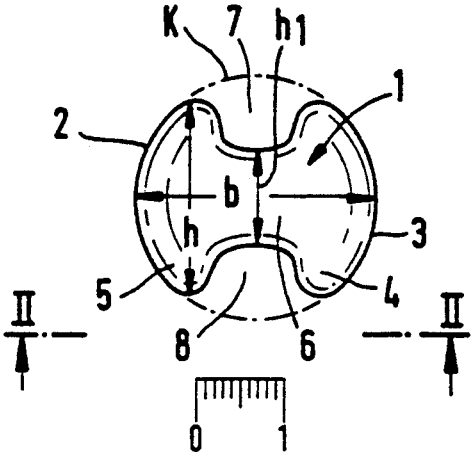
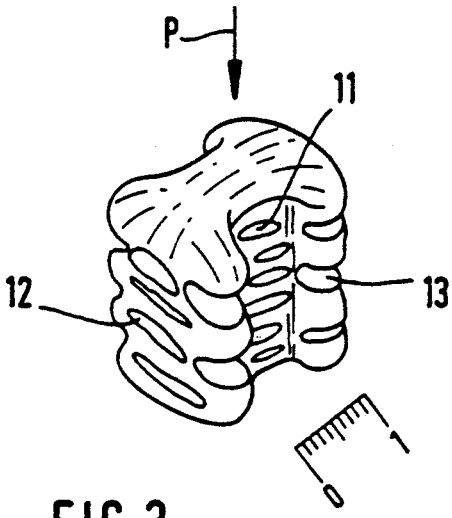
FIG.3
FIG.2
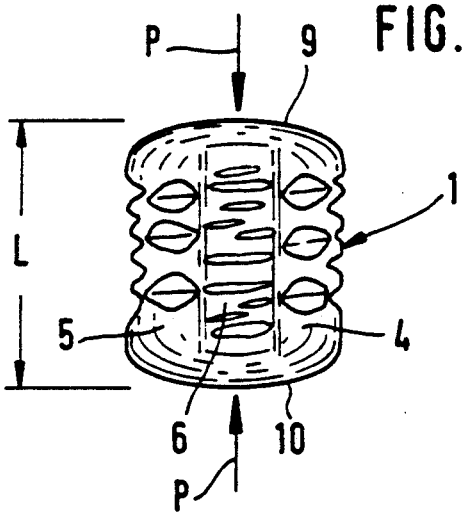
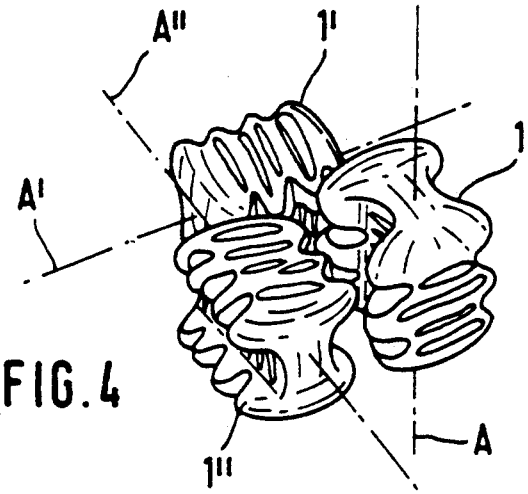
FIG.4
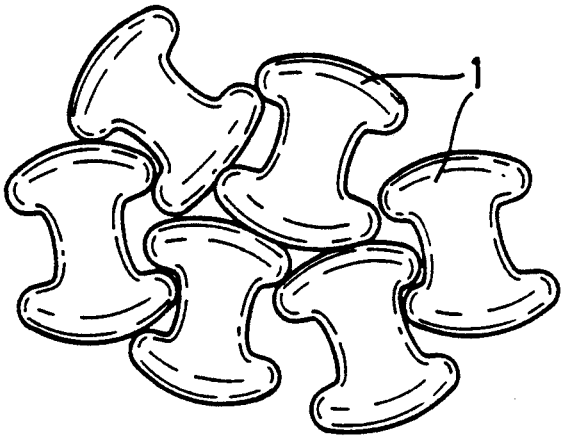
FIG.5

PACKAGING FILLERS

BACKGROUND OF THE INVENTION

1. Technical Field

The present invention relates to a packaging filler, which is formed by cutting off and foaming small pieces of extruded plastic.

2. Prior Art

Packaging fillers of this kind and of various shapes, known as loose fill chips, are known. Attempts to meet a number of different, sometimes contradictory demands as optimally as possible and all at the same time have been tried, such as: very lightweight fillers so that it is possible to fill large voids with relatively little weight; and sturdy fillers, that is, fillers that do not break when subjected to pressure and jarring. Quite the contrary, they should elastically absorb strains. The shape should also be embodied such that the material does not "settle" during transport; in other words, the fillers should "catch" onto one another as much as possible in a fixed position relative to one another when poured into a void, so that they do not change their relative position to one another, even under pressure and if jarred, and thus the volume filled with them or into which they have been poured remains reliably fully filled.

Known fillers include bodies of spherical segment shape (German Patent Document 23 59 064 C2), saddle-shaped articles (U.S. Re 27 243), small rods of circular or four-leaf-clover-shaped cross section (German Patent Document A 19 14 236), hook-shaped articles (U.S. Pat. No. 3,066,382), star-shaped (U.S. Pat. No. 3,188,264), gable-shaped and zig zag-shaped profiles (U.S. 500,586), pieces in the form of a saucer with an inwardly bent rim French Patent 24 82 930), articles having a FIG. eight cross section Patent Document 23 04 093 C), to mention a few.

However, none of these shapes is optimal for its particular intended application.

SUMMARY OF THE INVENTION

It is thus an object of the present invention to further develop a packaging filler of the type known above in such a way that with the least possible weight per volume filled with it, optimal resiliency and interlocking properties are attained.

According to the invention this object is attained in that the cross section of the packaging filler, or when viewed in plan view, is approximately in the shape of an H, with a transverse part and substantially elliptically embodied lateral parts extending therefrom, with rounded recesses being defined above and below the transverse part by the transverse part and the latter parts, and with the length of the packaging filler being at least equal to the height of the lateral parts.

In this way, a packaging filler with low weight per volume filled and good resiliency and interlocking properties is created, which can be manufactured at an extraordinarily favorable cost.

BRIEF DESCRIPTION OF THE DRAWINGS

One exemplar embodiment of the invention is described below, referring to the accompanying drawings. Shown are:

FIG. 1, which is a plan view of a packing filler according to the present invention;

FIG. 2, which is a side view of the packing filler of FIG. 1.;

FIG. 3, which is a perspective view of the packing filler of FIG. 1;

FIG. 4, which shows three packaging fillers disposed oriented variously with respect to one another; and FIG. 5, which shows a plurality of packaging fillers disposed oriented in the same way to one another, and seen in plan view.

DETAILED DESCRIPTION OF THE PREFERRED EMBODIMENT

As can be seen in FIG. 1, the packaging filler 1 according to the present invention has the shape in plan view and in cross section of approximately an H, the special feature of which, however, is that the H is embodied as very wide and rounded. The greatest width is for example b=approximately 2.5 cm, while the height h=approximately 2 cm. The two outer faces 2 and 3 are rounded, such that they can be considered to be part of an encompassing circle; that is, they are located approximately on the same circular cylinder jacket face K. As a result, the impression created is of thick lateral parts 4, 5 of the packaging filler 1, these parts themselves being elliptical when seen in plan view. The middle part 6, the transverse one in the H shape, has a height $h_1$ of approximately 0.8 mm, for example, or in other words is also relatively thick. The two resulting recesses 7 and 8 at the top and bottom to produce the H shape are highly rounded.

In the side view (FIG. 2), the packaging filler 1 has a substantially rectangular form, but as a consequence of the manufacturing method (expansion of polystyrene), the top and bottom faces 9 and 10, respectively, are rounded in spherical-segmental form like a flat cup.

From FIG. 2 and from the perspective view of FIG. 3, it can be seen that the side faces, that is, all of the faces of the packaging filler 1 except for the top face 9 and the bottom face 10, have a rippled, fissured texture; the impression (FIG. 3) is as if they had been created by stacking several parts on top of one another. The texture for instance has indentations 11, continuous ditch like depressions 12, and, in the lateral parts 4, 5, notches 13. The embodiment of this surface texture is produced in the manufacturing process, or in other words as a consequence of the expansion of the polystyrene. It is jointly responsible for the fact that the packaging filler 1 has excellent resilient properties in the direction of the arrows P shown in FIGS. 2 and 3, and that good interlocking of the various elements with one another is attainable when such packaging fillers are poured, because the upper and lower ends of the lateral parts 4, 5 can hook together relatively simply and in a variety of possible positions in these indentations, depressions or notches. Moreover, the embodiment of these indentations, depressions and notches is jointly responsible for the relatively low weight per unit of volume of the packaging filler.

FIG. 4 shows three packaging fillers 1, 1', 1'', which rest beside one another with their primary axes in various relative orientations A, A', A''. It can be seen that the shape of the individual packaging fillers creates large voids between the adjoining packaging fillers, even though the packaging fillers are securely braced against one another.

FIG. 5, is a plan view which shows a plurality of packaging fillers, all with the same orientation. Once again, the good opportunity for mutual interlocking with the end of the lateral parts 4 and 5 can be seen.

The production of the packaging fillers is done in a known manner (see for example German Patent Document 23 59 064 C1). Plastic billets of an H shaped profile are extruded. The height h of the extruded profile is approximately 3 mm. Small pieces of approximately 5 mm in length are cut from a continuously extruded billet. The expansion or foaming to make packaging fillers takes place only after an intervening resting phase, in each case in a heated, humid atmosphere (water vapor).

What is claimed is:

1. A packaging filler formed by cutting off and expanding small pieces of continuously extruded foamable plastic to have generally the shape of an H in plan view, comprising:

a transverse part; and two substantially elliptically shaped lateral parts extending one from each end of the transverse part, defining with the transverse part two spaced apart substantially rounded recesses, wherein the length of the packaging filler measured normal to the plane of the plan view is at least equal to the height of the lateral parts measured in the plane of the plan view.

2. The packaging filler as defined in claim 1, further wherein each lateral part defines an outer face, and wherein the outer faces of the two lateral parts form part of the same approximately circular cylinder jacket face.

3. The packaging filler as defined in claim 1, further wherein the packaging filler defines top and bottom faces each being rounded in spherical-segmental form.

4. The packaging filler as defined in claim 1, further wherein the transverse part and the plurality of lateral parts define side faces and top and bottom faces, with the side faces being provided with indentations, depressions and notches which extend parallel to the top and bottom faces.

* * * * *